United States Patent [19]

Smit

[11] Patent Number: 4,908,893

[45] Date of Patent: Mar. 20, 1990

[54] PILLOWS WITH PORTIONS WHICH DO NOT PROMOTE FACIAL WRINKLES

[76] Inventor: Julie A. Smit, 1045 Hinman Ave., Evanston, Ill. 60202

[21] Appl. No.: 297,954

[22] Filed: Jan. 17, 1989

[51] Int. Cl.[4] ..... A47C 20/02

[52] U.S. Cl. ..... 5/434; 5/441

[58] Field of Search ..... 5/434–437, 5/440, 441, 461, 449, 468

[56] References Cited

U.S. PATENT DOCUMENTS

| | | | |
|---|---|---|---|
| 2,216,818 | 10/1940 | Kuhlman | 5/449 |
| 2,295,906 | 9/1942 | Lacour | 5/436 |
| 2,561,931 | 7/1951 | Kleiser, Jr. | 5/441 |
| 2,688,142 | 9/1954 | Jensen | 5/441 X |
| 2,940,087 | 6/1960 | Kiefer | 5/436 |
| 3,403,413 | 10/1968 | Calhoun et al. | 5/440 X |
| 3,694,831 | 10/1972 | Treace | 5/435 |
| 3,851,347 | 12/1974 | Ashley | 5/436 |
| 4,432,107 | 2/1984 | Clark et al. | 5/436 |
| 4,757,983 | 7/1988 | Ray et al. | 5/435 X |
| 4,788,728 | 12/1988 | Lake | 5/436 X |

FOREIGN PATENT DOCUMENTS

| | | | |
|---|---|---|---|
| 1199533 | 7/1970 | United Kingdom | 5/435 |

*Primary Examiner*—Michael F. Trettel

*Attorney, Agent, or Firm*—Laff, Whitesel, Conte & Saret

[57] ABSTRACT

A beauty pillow contains at least one open or concave area incorporated in a surface thereof. The area is shaped and dimensioned for a person to rest a region of delicate facial tissue thereover, and further is contoured not to touch or rub against the region of delicate facial tissue during normal usage. The pillow surrounding the open or concave area supports the bony structures of the skull and jaw, so that regions of delicate facial tissue remain unstressed and not wrinkled, especially during sleep.

8 Claims, 3 Drawing Sheets

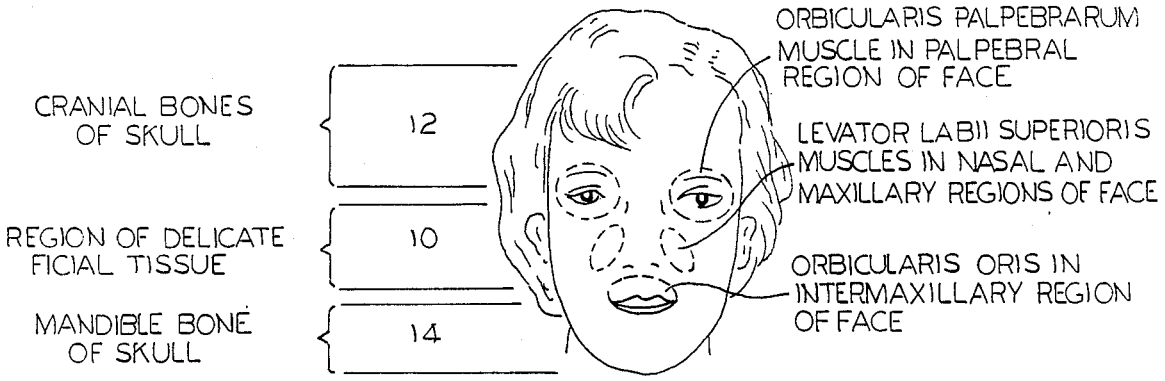
FIG.1
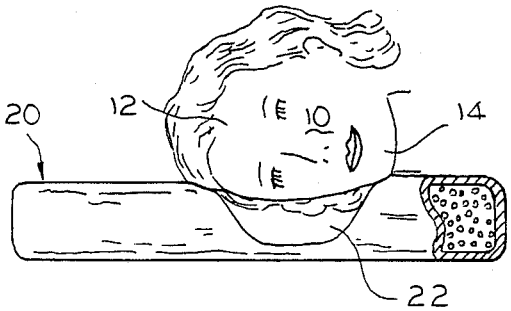
FIG.2A
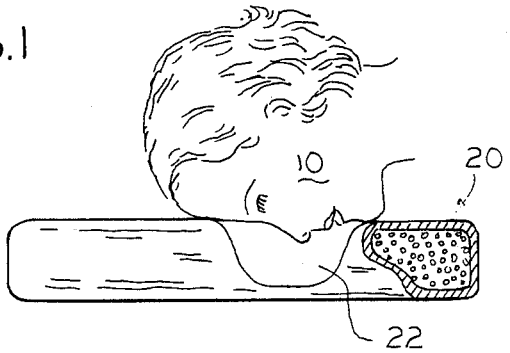
FIG.2B
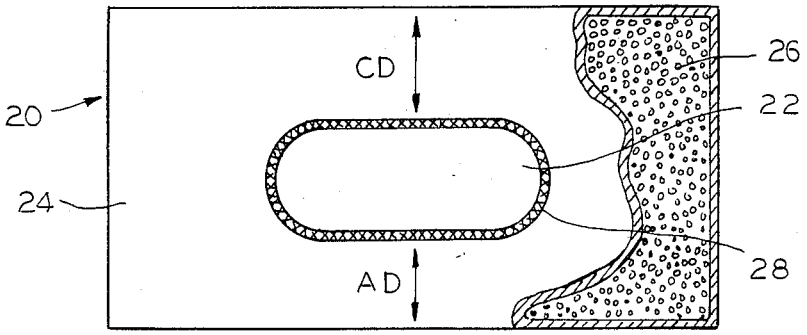
FIG.3
FIG.4
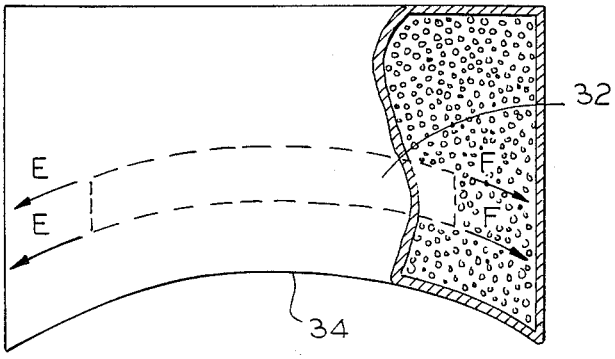

PILLOWS WITH PORTIONS WHICH DO NOT PROMOTE FACIAL WRINKLES

This invention relates to beauty pillows and more particularly to pillows which do not apply pressure to selected areas of the face in order to prevent facial wrinkles from forming during sleep.

Usually, the face is the first portion of the body to wrinkle, which points to a problem wherein sleeping on conventional pillows is likely to advance facial wrinkles. More particularly, people sleep approximately eight hours per day with their faces pressed against or into a pillow. The resulting pressure tends to create stress marks or creases in the soft facial tissue, especially in the areas around the eyes and upper lip. As the years progress, an adult's face loses its elasticity and these stress marks or creases eventually advance into or at least accelerate the formation of facial wrinkles.

Accordingly, an object of this invention is to provide new and improved pillows with either open holes or concave portions which do not apply pressure to selected regions of the face during sleep.

Another object of this invention is to provide comfortable pillows which protect facial regions from pressure during sleep.

Yet another object of this invention is to provide pillows for persons who have had plastic surgery on their nose, eyes, ears, face, etc., to protect the surgical area, especially during the healing process.

Still another object of this invention is to provide pillows for burn victims, sunburn included.

In keeping with an aspect of the invention, a pillow is filled with or made of a suitable soft material, such as: foam rubber, fiber, feathers, fluid, air, or the like. In most embodiments, the central portion of the inventive pillow contains either an open hole or a concave portion. Therefore, the pillow does not rub or come into contact with selected regions of the face. The open hole or concave portion may be substantially any desired shape and size, as long as it matches a specific skin area on the face.

The preferred embodiments of the invention may become more apparent from the following specification, taken with the attached drawings, wherein:

FIG. 1 is a diagram of a human head and of the facial regions which are most prone to pillow caused wrinkles;

FIGS. 2A and 2B illustrate how the inventive pillow protects selected facial tissue during sleep;

FIG. 3 shows a pillow, with a fragmentary cross section and with a hole or concave portion formed into its central portion;

FIG. 4 is a pillow with an arcuate-shaped, depression therewith;

FIG. 1 shows a human head and identifies the delicate facial areas which are most prone to wrinkles. In greater detail, there are three areas of soft skin tissue, on each side of the face, which are especially prone to early wrinkles responsive to repeated or prolonged stress marks because the tissue within these areas are quite thin.

Figure 5:
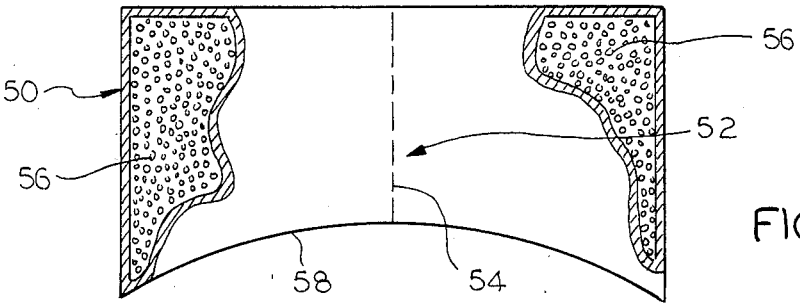
FIG. 5 shows a pillow with linear stitching which forms the pillow into a valley for the face to rest over.

The first such area is over the Orbicularis Palpebral Muscle and is the skin tissue located in the palpebral region of the face, or the area under and surrounding each eye socket. The skin tissue in this area is extremely thin and highly susceptible to premature wrinkling.

The second area prone to early facial wrinkles is the upper lip or intermaxillary region which is located above and surrounding the ends of the mouth. The intermaxillary region contains the Orbicularis Oris Muscle and its overlying skin tissue.

The third region of easily stressed facial skin is the nasal and maxillary regions which include the two Levator Labia Superioris Muscles. This area begins a short distance below the nostrils and continues upwardly and along each side of the nose to just below the bottom of the eye socket.

Sleeping on conventional pillows stretches and creases these thin-skinned areas, creating stress marks on the face. Usually, by the mid-twenties, most people begin to notice faint lines under their eyes and also between the nostrils and upper lip.

The above described regions (shown by dashed lines in FIG. 1) are hereinafter called "selected facial tissue" or "regions of delicate facial tissue" 10. The regions of delicate facial tissue 10 encompass approximately three and one half vertical inches of facial area on an adult face. According to the invention, during sleep, these regions of delicate facial tissue 10 are supported over the hole or concave area in the inventive pillow. Stated another way the pillow supports the bony structures of the skull. The cranial bones of the skull 12 and the mandible (or jaw bone) 14 rest upon the bulky areas of the inventive pillow while the regions of delicate facial tissue 10 rest over a hole or concave opening in the inventive pillow.

FIGS. 2A and 2B illustrate how the inventive pillow protects the regions of delicate facial tissue 10 during sleep. In greater detail, FIG. 2A shows the inventive pillow 20 with the side of a face resting upon it and over concave area 22. The head is supported by the pillow 20 underlying the tissue over the cranial bones 12 and mandible 14.

Pillow 20 is also comfortable for persons who sleep on their backs since hole or opening 22 forms somewhat of a nest for the back of a head to rest in. Accordingly, pillow 20 can be used to train persons to sleep on their backs because hole or concave opening 22 tends to hold the back of the head in place during sleep. This is especially desirous after facial surgery while the face needs protection during sleep.

FIG. 3 shows the inventive pillow 20 with a hole or concave opening 22 formed in its central portion. In greater detail, to make a concave opening, pillow 20 is formed by sewing two layers of fabric together to form a case 24 for containing any suitable stuffing material 26. Prior to stuffing the case 24, a hole 22 of a desired shape and size may be cut into the lower central portion of case 24. The hole 22 should be approximately 3½ inches or less in its vertical dimension when its horizontal dimension exceeds 3½ inches. A hole having a substantially larger vertical dimension is too large to correctly support the tissues over the bony structures of the skull, and the head and face begins to sink into hole 22. The upper and lower layers of pillow fabric material is then sewn shut around the outer perimeter of hole 22 and finished with a suitable stitching 28.

Usually pillow 20 should contain enough stuffing material 26 to make it at least two inches thick in order to support the weight of the head and to keep the hole or concave opening 22 open to a desired depth.

Additionally, pillow 20 preferably has less distance in the lower region taken along the line AB between the lower edge and the hole or concave opening 22 where the neck and chin rest than in the upper region identified by line CD. Preferably, the length of line AB is somewhat equivalent to the length of a human chin, or combination of neck and chin. In one pillow that was made and tested, line AB is approximately 3½ inches in length. The distance CD may be any suitable length and should be sufficient to provide an adequate bulk in order to support most of the weight of the head. In one pillow that was made and tested, line CD is approximately 5½ inches (or greater) in length. The dimension of hole or concave opening 22 can be increased or decreased somewhat according to a person's comfort preferences.

A standard type of pillowcase may be placed over pillow 20, as well as other embodiments of the inventive pillow to keep them clean and sanitary. The pillowcase should be large enough to conform to the shape of pillow 20 when the head is placed on it.

Pillow 20 has thus far been disclosed as being filled with stuffing material 26; however, it may also be made from a solid piece of sponge, foam rubber, or the like, with a hole 22 punched through or almost through it.

FIG. 4 shows a pillow 30 with an unstuffed arcuate-shaped section 32 depression therein. Pillow 30 contains an inwardly curved bottom edge portion 34 which is generally parallel to the curve of the arcuate-shaped curve 32. This design is compatible with sleeping on one's side. When one turns from side to side during sleep, the arcuate curve better corresponds to the regions of delicate facial tissue since the path followed by these tissues as the head rolls tends to follow the lines E-F.

FIG. 5 shows another alternative embodiment of the inventive pillow with a vertical, indented, linear section 52. The indented, linear section 52 is formed by a stitched line 54 extending across pillow 50 and joining the upper and lower layers of fabric forming the pillow cover. Pillow 50 is then stuffed with a suitable filler material 56 for establishing a desired height and volume. Thereafter, pillow 50 is inflated with stuffing in the area of filler material 56 but is selectively indented or valley-shaped along stitched line 54. In use, much of a person's face rests over the indented section 52 in pillow 50. The sides of the face and head are supported by the areas of filler material 56 on each side of the indented section 52. Stitched line 54 may also run horizontally across pillow 50 when only a horizontal protection is desired. Additionally the bottom of pillow 50 may be curved inwardly, as shown, to form a somewhat crescent-shaped lower edge 58 and to provide a better fit for the neck and shoulders. As a rule, the length of the open hole or concave portions of the inventive pillows can be positioned either horizontally or vertically, (horizontally giving a little better facial protection), so long as either the width or the length of the depression does not exceed 3½ inches. In other words, if the length of the depression runs 10 vertical inches, then the width should not exceed 3½ inches, otherwise the head and face may sink into the hole. Accordingly, if the depression runs horizontally across the pillow for 12 inches, then the width should not exceed 3½ inches.

Figure 6:
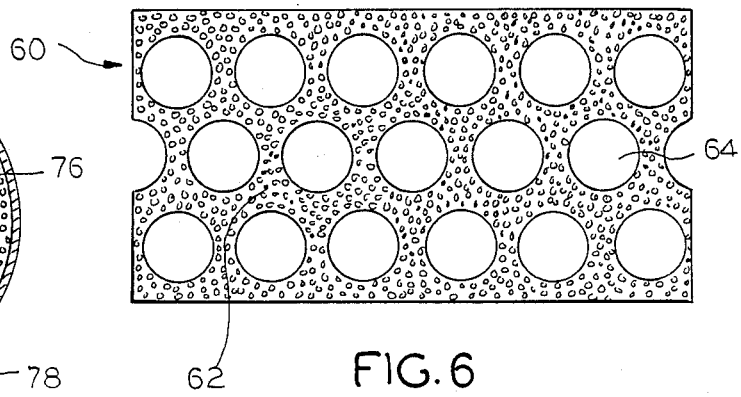
FIG. 6 shows a pillow in which holes are punched in order to limit the surface area of the pillow.

FIG. 6 shows a pillow 60 having a core made of foam rubber, sponge, or the like 62, for example, and formed with holes 64 therein. The more holes 64 that are formed in the foam rubber, sponge 62, the less contact there is with the facial tissue or other skin area. Since the total surface area of the pillow 60 has at least as much open area as foam rubber surface area there is less material to rub upon the facial tissue.

Figure 7:
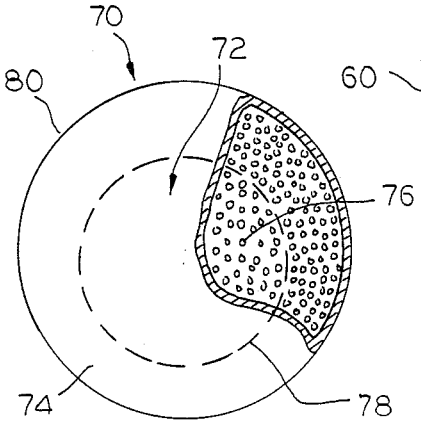
FIG. 7 shows a pillow with a fragmentary cross section which has a concave central portion.

FIG. 7 shows a round pillow 70 with a shallow, foam-filled portion 72. Pillow 70 is formed from two layers of fabric 74. Preferably, a thin layer of foam material 76 is placed between the two layers of fabric 74 which are stitched together to form the central portion of pillow 70 in a suitable pattern, here shown as a circle 78. The remainder of pillow 70 is then stuffed with foam material 76 and fully sealed around its outer perimeter 80. Thus, pillow 70 contains a shallow, cushioning, foam-filled portion 72 surrounded by a much thicker, full bodied, foam pillow.

Figure 8:
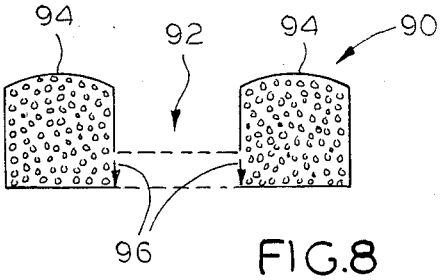
FIG. 8 is a cross section of a side view of the inventive pillow.

FIG. 8 schematically shows a cross section side view of any of the pillows incorporating the invention. Here a pillow 90 contains an indented section 92 surrounded or partially surrounded by a much thicker area of soft filler material 94. The thickness of indented section 92 can be further reduced as shown by arrows 96, until it becomes an open hole.

Figure 9:
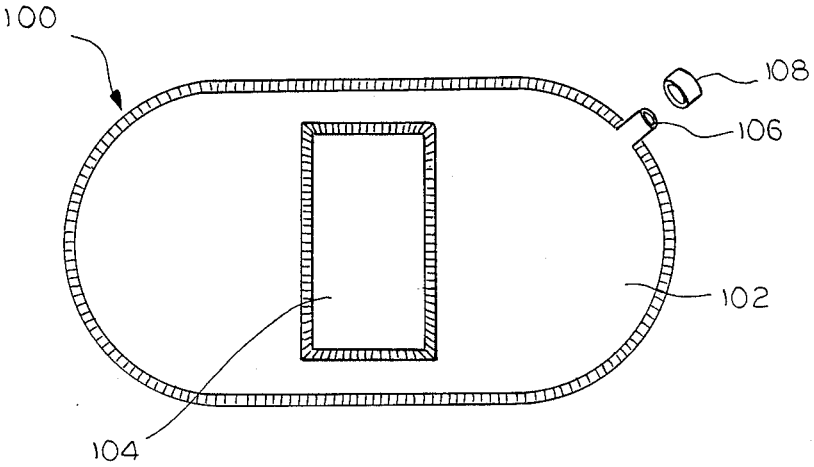
FIG. 9 is a cross-section which shows a form of the inventive pillow which may be filled with fluid or air.

FIG. 9 shows an alternate embodiment in which the inventive pillow may be filled with any suitable fluid (including air). In greater detail, FIG. 9 shows a pillow 100 containing a bladder 102. The central portion of pillow 100 contains a hole 104 of any desired size and shape. An empty/fill opening 106 is provided in pillow 100 for inflating or emptying the bladder, the softness of a filled bladder being according to an individual's preference. Cap 108 seals the bladder 102. Alternately, pillow 100 may be filled with a gelatin like substance which is permanently sealed within bladder 102. The gelatin substance would readily adjust itself to a person's head and neck contour while still supporting the regions of delicate facial tissue 10 over hole 104.

Figure 10:
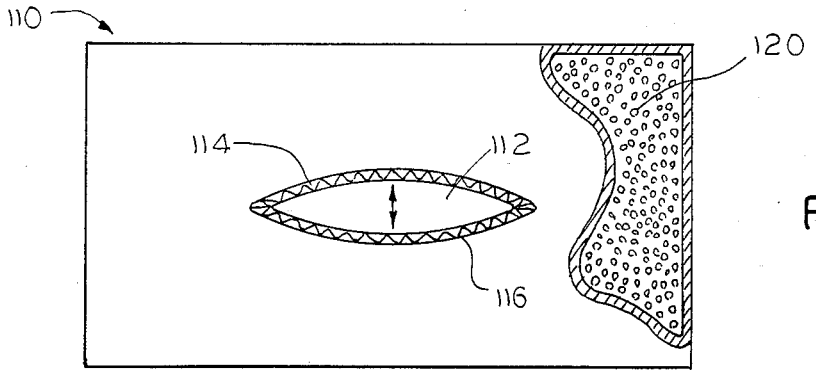
FIG. 10 shows a pillow in which a centrally located slit opening may be expanded and molded into a hole of any desired shape.

FIG. 10 shows an alternate embodiment of pillow 110 wherein the perimeter of a slit opening 112 may be molded to a desired size and shape. Slit opening 112 contains a semi-flexible wire 114, which is padded at 116, so that a person can readily bend the wire to adjust the slit opening 112 to fit a desired skin area. Pillow 110 is filled with any suitable stuffing material 120.

Figure 11:
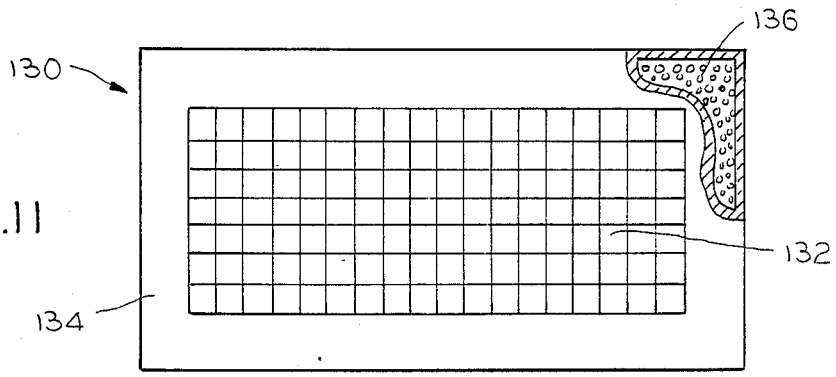
FIG. 11 shows a pillow made of a netting or weave for limiting its surface area.

FIG. 11 shows a pillow 130 in which a weave or netting material 132 is incorporated into or over a frame 134 of any suitable shape. Frame 134 may be made of or filled with any suitable soft pliable material 136 which is comfortable and compatible with sleeping.

Figure 12:
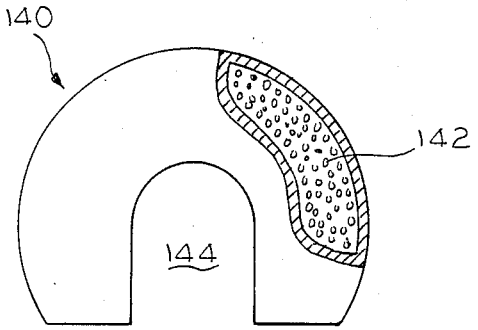
FIG. 12 shows a horseshoe shaped pillow.

FIG. 12 shows a horseshoe-shaped pillow 140 which may be made of foam rubber, fiber, feathers, filled with a fluid or gelatin, or the like 142. The sides and top of the face and cranial bones 12 and mandible 14 rest upon the walls of the horseshoe-shaped pillow 140 with the delicate facial tissue 10 positioned over the inverted "U" shaped open area 144.

Figure 13:
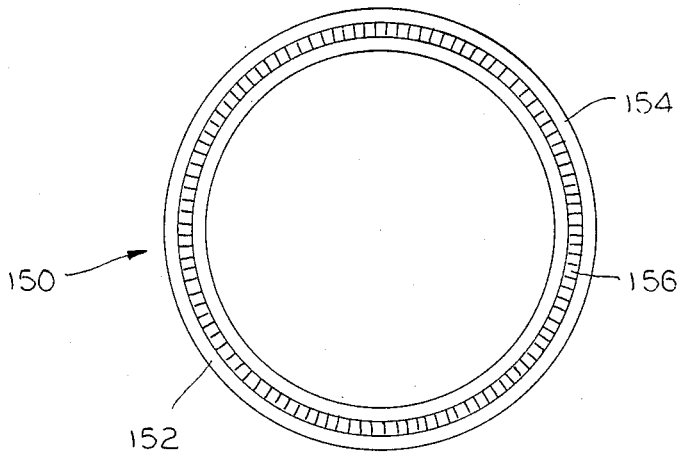
FIG. 13 is an attachment which may be used with a standard or conventional pillow.

FIG. 13 shows a double ring attachment 150 (similar to an embroidery ring), which is used to convert a standard pillow into the inventive pillow. In greater detail, double ring attachment 150 has a larger ring 152 which contains a three sided U-shaped cross section channel. A slightly smaller ring 156 fits into the open channel part of the U. In operation, any loosely stuffed pillow is spread with much of the loose stuffing pushed out of the lower central portion of the pillow and into the surrounding areas of the pillow. The larger ring 152 is placed on the bottom of the pillow and the slightly smaller ring 156 is placed on top of the pillow and snapped into channel of the U. For comfort, the top of ring 156 may be padded.

The principle of pillows with the open hole or concave center should now be apparent. When a person rests his face over the open hole or concave portion, the thinnest-skinned, wrinkle-prone, facial regions are not creased or stressed. Furthermore, the inventive pillow protects facial burns and surgical areas by "nesting" the back of the head within the open hole or concave depression.

The inventive pillows of this application can readily be modified and combined. For example, any of the pillows may have either a concave center or an open hole. Furthermore, many embodiments of the pillow may contain the padded semi-flexible wire means for molding the open hole or concave area into a desired size and shape. Additionally, all embodiments of the pillows may have bladders containing fluid, gel, or air. Also, the sewn and stitched areas mentioned above could be sealed or bonded together by other means.

Therefore, the appended claims are to be construed broadly enough to cover all equivalent structures falling within the scope and spirit of this invention.

I claim:

1. A pillow comprising a pliable body having at least an upper surface containing at least one open or concave area, said area being formed in a region on said upper surface which is generally defined no higher than a central horizontal portion of said pillow with said area being generally parallel with a lower edge of said pillow, said area being shaped and dimensioned for a person to rest delicate facial tissue in and around the area of the person's eyes, said area being contoured downwardly into the pillow so as not to touch or rub against said region of delicate facial tissue during normal usage, said pillow surrounding said area supporting tissue over the bony structures of the skull and jaw, whereby said region of delicate facial tissue remains unstressed and not wrinkled, especially during sleep, said pillow further having at least one arcuate shape formed along said lower edge of said pillow, said arcuate shape being curved inwardly for generally conforming to said person's shoulder and said open or concave area on said upper surface also having an arcuate shape generally conforming to a path followed by the delicate facial tissue part of the person's face as the head rolls from side to side.

2. The pillow of claim 1 wherein said area is a hole formed in said pillow.

3. The pillow of claim 1 wherein said concave area comprises a substantially curvilinear line forming an abrupt valley-like depression extending across the pillow and between areas of much greater bulk, whereby a person may rest said region of delicate facial tissue over said abrupt, valley-like depression without said region of delicate facial tissue coming into contact with said greater bulk of said pillow.

4. The pillow of claim 1 wherein said concave area comprises an area of little thickness surrounded by areas of much greater thickness.

5. The pillow of claim 1 wherein said pillow contains an air-tight bladder which may be inflated with a substance which increases the bladder to a desired volume while maintaining a soft surface on said bladder.

6. The pillow of claim 1 wherein said pillow comprises a case filled with a soft, pliable substance.

7. The pillow of claim 1 wherein said pillow is made from a foam rubber sponge or fiber material.

8. A process for preventing pillow pressure from being applied during sleep to soft tissue of a thin-skinned facial area in and around a person's eyes, said process comprising the steps of: providing a pliable pillow with a surface having an open or concave portion of a size and shape corresponding to said thin-skinned facial area in and around the eyes, forming said open or concave area into at least an area which is in a general proximity to a central portion of said pillow with said open area extending parallel to a bottom edge of said pillow, the position of said open or concave area providing a portion on the surface of said pillow which does not touch or rub against said thin-skinned facial area while providing a bulky area of said pillow outside said open or concave area for the tissue over the bony structure of a skull and jaw resting upon said pillow, and providing a generally smooth, level contour over the surface of said pillow except in the area of said pillow which is in direct proximity to said open or concave portion wherein the thickness of said pillow decreases abruptly at the edge of said open or concave area, whereby the overall surface of said pillow gives a generally smooth and level feel to the person resting upon it; and further arcuately curving said pillow's bottom edge inwardly to conform to a person's shoulder and head movements, said open or concave area being formed into an arcuate shape for conforming to a path followed by a part of the face in the area in and around the eyes while the head rolls from side to side.

* * * * *